US007963611B1

(12) United States Patent
Kwiatkowski

(10) Patent No.: US 7,963,611 B1
(45) Date of Patent: Jun. 21, 2011

(54) WHEELCHAIR LEG SUPPORT

(76) Inventor: Margaret E. Kwiatkowski, St. Clair Shores, MI (US)

( * ) Notice: Subject to any disclaimer, the term of this patent is extended or adjusted under 35 U.S.C. 154(b) by 0 days.

(21) Appl. No.: 12/854,356

(22) Filed: Aug. 11, 2010

Related U.S. Application Data

(63) Continuation of application No. 12/417,700, filed on Apr. 3, 2009, now Pat. No. 7,780,239.

(51) Int. Cl.
*A47C 7/52* (2006.01)

(52) U.S. Cl. ..... 297/423.4; 297/423.39; 5/648

(58) Field of Classification Search ..... 297/423.39, 297/423.4; 5/648, 650
See application file for complete search history.

(56) References Cited

U.S. PATENT DOCUMENTS

| | | | | | |
|---|---|---|---|---|---|
| 830,776 | A | * | 9/1906 | Flagg | 5/648 |
| 1,400,625 | A | | 12/1921 | Rawlinson | |
| 2,781,827 | A | | 2/1957 | Bell | |
| 3,167,351 | A | | 1/1965 | Butler | |
| 3,532,336 | A | * | 10/1970 | Baker | 5/650 |
| 3,792,897 | A | | 2/1974 | Alson | |
| 4,432,108 | A | * | 2/1984 | Chapman | 5/648 |
| 4,564,238 | A | | 1/1986 | Wolpert, Jr. | |
| 4,910,818 | A | | 3/1990 | Grabill et al. | |
| 5,449,221 | A | | 9/1995 | Stander | |
| 5,971,486 | A | | 10/1999 | Petre | |
| 2005/0151408 | A1 | | 7/2005 | Pratte et al. | |
| 2007/0001503 | A1 | | 1/2007 | Brady | |

* cited by examiner

*Primary Examiner* — Peter R. Brown
(74) *Attorney, Agent, or Firm* — Young Basile

(57) ABSTRACT

A wheelchair leg support includes a pad having an inclined upper portion for supporting an upper leg and a lower portion extending angularly downward from the upper portion for supporting a user's leg and preventing a user's lower legs or feet from passing beneath a moving wheelchair avoiding injury. The lower portion includes a relief or cut-out to cradle the lower leg to resist the leg from slipping off the leg support and for comfort of the user.

18 Claims, 3 Drawing Sheets

WHEELCHAIR LEG SUPPORT

CROSS-REFERENCE TO RELATED APPLICATION

This continuation application claims the priority benefit of U.S. patent application Ser. No. 12/417,700 filed Apr. 3, 2009, the entire contents of which are herein incorporated.

TECHNICAL FIELD

The invention generally relates to the field of medical equipment. The present invention has been found to be particularly useful with wheelchairs.

BACKGROUND

As people age, their mobility often decreases and many have difficulty at some point in their lives with their hips, knees or ankles. Many elderly people, or younger people due to injury or disease, are confined to a wheelchair for at least a period of time to move from place to place. It is common for people using wheelchairs to have difficulty with lifting or raising one or more of their legs for any length of time due to age, injury or disease. It is also common for people using wheelchairs, if they are able, to use one or more of their legs and feet to propel themselves along using their heels or bottoms of the foot to scoot or move themselves forward.

Manually-operated wheelchairs, in other words those requiring the user to exert force to move the chair, have not significantly changed in design or technology over the years. Devices used to support a person's foot or feet, commonly called pedals, are heavy metal plates which are slid into receptacles attached to the wheel chair frame by the front wheels. These pedals may be rotated out of the way or removed if, for example, a user is going to stand up or otherwise exit the wheelchair.

Wheelchair pedals have many disadvantages in use and safely supporting one or more of a user's feet while seated in a wheelchair or exiting therefrom. These pedals are typically not interchangeable between wheelchair manufacturers and with the different size wheelchairs causing difficulties in use for the facilities that employ them. When installed, the pedals usually extend a bit outwardly and cause damage to facility walls, door frames and other equipment. For users, the pedal designs allow for a foot to slip off of a pedal allowing the leg and foot to drop down toward the floor. If the wheelchair is in motion, the foot can be drawn by contact with the floor under the wheelchair or into the front wheels causing injury to the foot, ankle and knees. When only one pedal is used, for example only one leg of a user is injured, propelling the chair by the user's good leg often causes bruises or abrasions when the good foot comes in repeated contact with the heavy metal pedal. The standard wheelchair pedals are also simply not usable in situations where a user has an injury to the heel or foot and must avoid pressure that a pedal would provide. Use of pedals is also known to cause or contribute to contractures and edema if they are used too often

BRIEF SUMMARY

The present leg support and method includes a pad for supporting one or both of a person's leg while seated in a chair so that the person's foot supported by the pad is elevated above the floor. The device is particularly useful for persons on wheelchairs, but is not limited to that use.

In one example of the leg support, the leg support includes a pad having an upper portion which is positioned in contact with the seat and a lower portion which extends angularly downward from the upper portion beyond the front edge of the seat. In a preferred example, the pad includes a clamp for secure attachment of the pad to the front edge of the seat so the pad cannot slide off of the seat. In use, the user's leg is positioned on and supported by the upper portion and at least a portion of the user's lower leg is supported by the angled lower portion such that the user's supported foot is elevated above the floor so that the foot cannot drop down under the chair or into the path of the wheels. The pad is easily removed when the user intends to exit the chair or is not needed.

In one example of the leg support, the first portion which supports the user's upper leg is angled slightly upward from the seat raising the person's knee which further elevates the user's foot above the floor and provides resistance from the user slouching or sliding toward the edge of the seat.

In another example of the leg support, the pad lower support includes a relief or recessed channel down into the lower portion which cradles, for example a portion of the user's calf, further preventing the leg and foot from sliding or falling off of the pad providing an additional level of security preventing the user's foot from dropping to the floor and underneath the wheelchair while in motion.

In another example, the leg support includes a base which provides a rigid support for the pad, for example if the pad is made from a soft or cushiony foam material where added comfort is needed.

In another example, the leg support includes a storage hook on the underside of the lower portion out of the way of the user. This storage hook or device allows the leg support to be hung, for example, on the wheelchair seatback out of the way of the user, but remains with the wheelchair and user should it be quickly or conveniently needed.

Other advantages of the inventive leg support include that it is: lightweight; portable; easy to install, remove and store; easy to clean and maintain; promotes increased comfort and security for the user; and easy all around use for health care facilities, private homes any anywhere individuals with temporary or permanent leg, ankle or foot disabilities reside or pass through.

Other features, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE INVENTION

Figure 1:
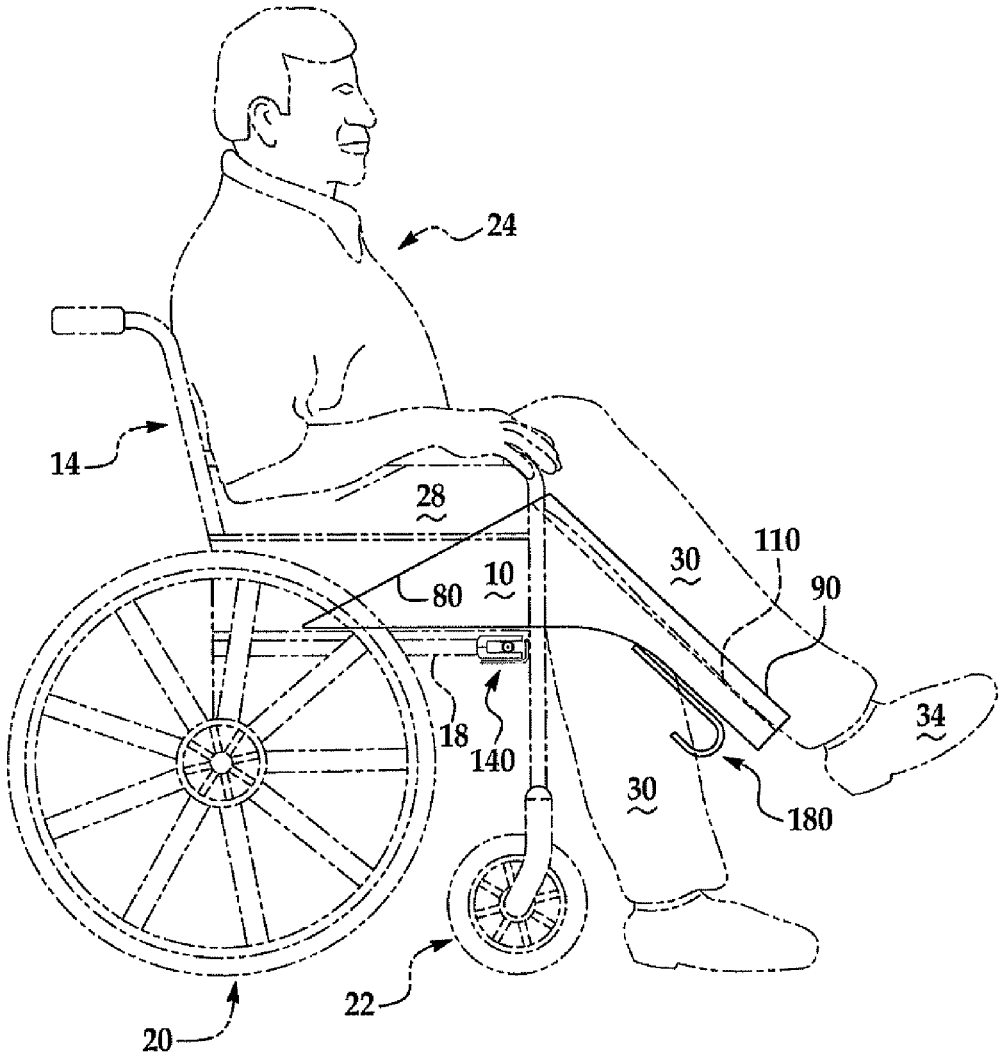
FIG. 1 is a schematic drawing of the inventive leg support in an exemplary use for a person in a wheelchair.

Referring to FIGS. 1-5 examples of a leg support are shown. FIG. 1 shows the leg support in use with a wheelchair which has shown to be of particular, but not exclusive use.

Figure 2:
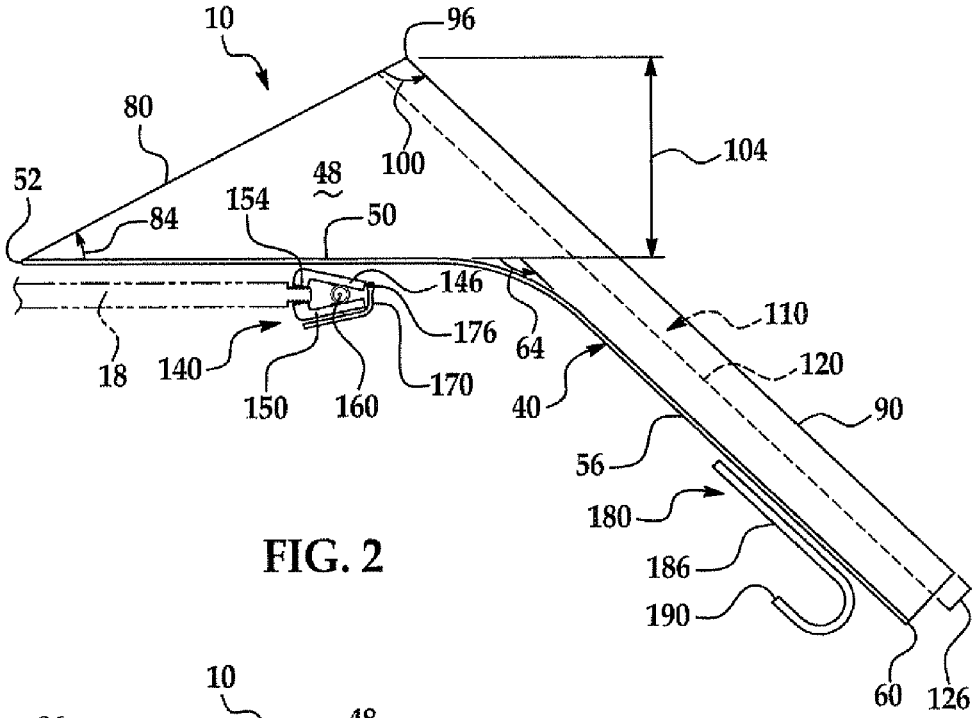
FIG. 2 is a side view of one example of the leg support shown in FIG. 1.

Referring to FIGS. 1 and 2, one example of a leg support 10 is shown in an exemplary use with a wheelchair 14 (shown in phantom). Wheelchair 14 includes a seat 18, rear wheels 20 and front wheels 22. A user or occupant 24 having two legs, each leg including an upper leg portion 28, a lower leg portion 30 and a foot 34.

One example of leg support 10 shown in FIGS. 1 and 2 includes a base 40. Base 40 is preferably a substantially rigid plate or layer which provides a rigid foundation or support layer for leg support 10. Base 40 can be made from thin, lightweight and substantially rigid materials such as aluminum, stainless steel, polymers, elastomers and other materials known by those skilled in the art with these characteristics.

Leg support 10 further includes a pad 48. In the example shown, pad 48 includes an upper portion 50 having a first end 52 and lower portion 56 and a second end 60. In the preferred example shown, the part of pad upper portion 50 that is placed in contact with seat 18 is substantially planar and positioned horizontally in use. In one example, upper portion 50 first end 52 is positioned approximately six (6) inches toward the back of seat 18 from the forward seat 18 edge. More or less overlap or contact of upper portion 50 on seat 18 may be used to suit the particular application and user. Lower portion extends beyond a forward edge of seat 18 at an angle 64 downwardly toward the floor (not shown) upon which the wheelchair rests. Pad 48 may be made from a relatively soft compressible foam material which provides adequate structure to support a user's 24 legs but provides a cushiony surface for user comfort. In a preferred example, a visco-elastic memory-type foam is used to partially compress under weight or force, but recovers to its original shape once the force or weight is released. It is also contemplated that pad 48 could be made from multi-layers or multi-components, for example, having a semi-rigid core with a soft foam covering. It is understood that depending on the composition and rigidity of pad 48, portions of substantially rigid base 40 may be laminated, or base 40 may be eliminated altogether.

As best seen in FIGS. 1 and 2, in a preferred application, leg support 10 pad 48 is positioned over at least a portion of the top of wheelchair seat 18 below at least a portion of the bottom of user 24 as best seen in FIG. 1. Depending on the shape and orientation of pad upper portion 50 discussed further below, pad 48 could be positioned all of the way toward the back of seat 18 (not shown) or more toward the forward edge of seat 18 (not shown).

Figure 3:
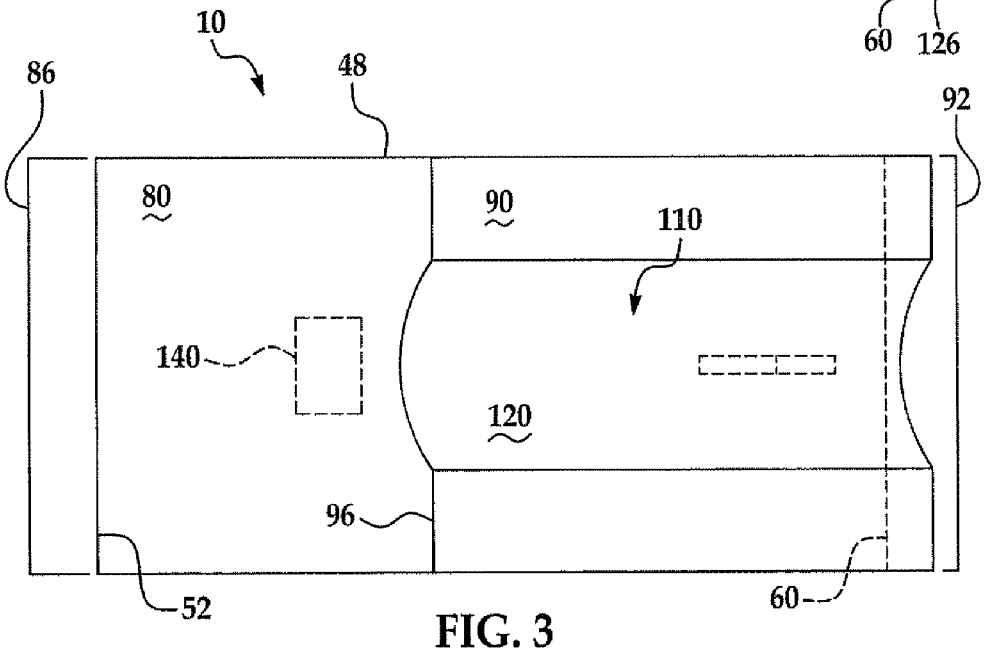
FIG. 3 is a top view of the leg support shown in FIG. 2.
Figure 4:
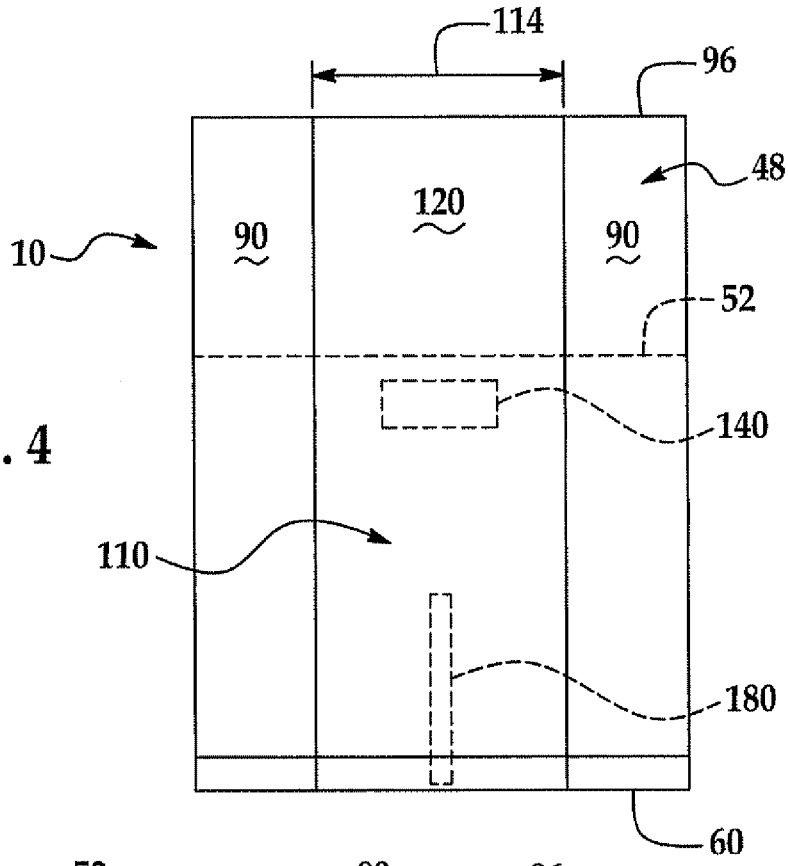
FIG. 4 is a right side view of the leg support shown in FIG. 2.
Figure 5:
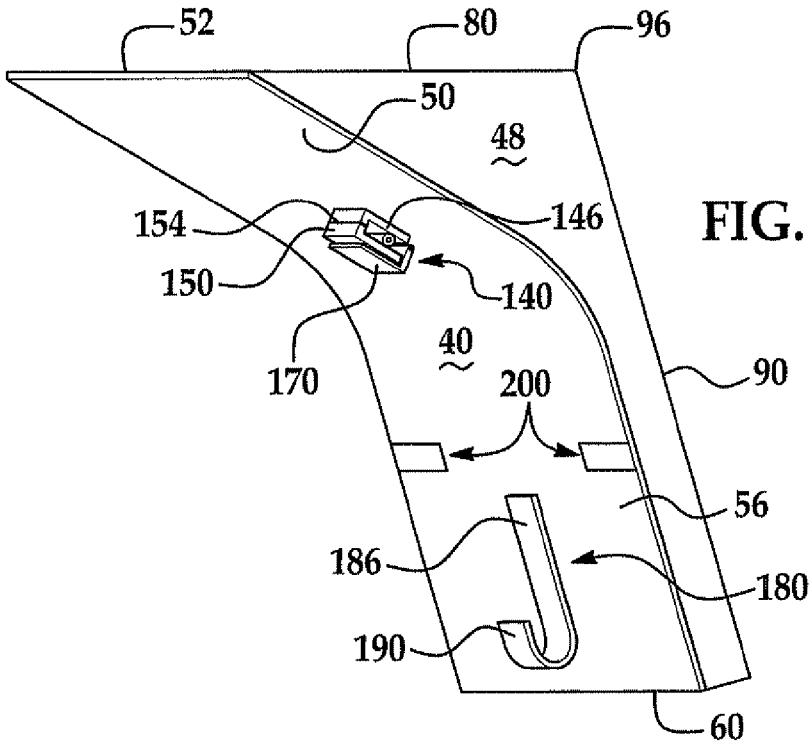
FIG. 5 is a perspective view of the back or underside of the leg support shown in FIG. 2.

In a preferred example shown in FIGS. 1-5, pad 48 upper portion 50 includes a first surface 80 as best seen in FIGS. 1, 2 and 5. First surface 80 is for use in supporting user 24 upper leg portion 28 as best seen in FIG. 1. In the example shown, first surface 80 inclines at an angle 84 from first end 52 toward an apex 96 as best seen in FIG. 2. A useful advantage of having first surface 80 at an upward angle is that this inclined surface assists in the user slouching or slipping forward in the chair toward the forward end of seat 18.

As best seen in FIG. 3, first surface 80 has a width 86. In a preferred example for a standard 16 inch wide wheelchair, where leg support 10 is used for supporting a single leg, width 86 is approximately seven (7) inches and the height 104 at the apex 96 is approximately three (3) inches. It is understood that angle 84, width 86, and height 104 may vary depending on the style and size of the wheelchair and physical features or needs of the user. It is contemplated that alternate sizes for leg support 10 would be made to accommodate bariatric, pediatric and extra tall persons. For example, leg support 10 could be manufactured to have a single pad that is wide enough to support both a users legs (not shown). In an alternate example not shown, pad upper portion 50 and first surface 80 are configured so as to provide only a small pad or cushion layer that does not extend upward at an angle 84, but rather extends forward substantially parallel to wheelchair seat 18.

In the preferred example shown in FIGS. 1-5, leg support 10 lower portion 56 includes a second surface 90 for supporting a user 24 lower leg portion 30. In the example shown, second surface 90 extends downward at an angle 100 from first surface 80 as best seen in FIG. 2. As shown in FIGS. 2-4, second surface 90 preferably includes a relief or cut-out 110 extending into the pad lower portion 56 to provide a recessed cradle or channel for receipt of the lower leg portion 30 of a user as more fully described below. In the example shown, relief 110 is semi-circular and includes a width 114 and a depth 126 which defines a recessed support surface 120 for direct contact with lower leg portion 30. The dimensions of relief 110 may vary depending on the characteristics and needs of the user. A useful advantage of relief 110 is that it provides a cradle for the lower leg portion 30 to be seated at least partially down into which then resists movement of the lower leg portion 30 out of the relief 110 preventing unwanted movement of the leg which could be uncomfortable for the user or may aggravate an existing medical condition.

In the example shown as best seen in FIGS. 1 and 2, lower portion 56 and second surface 90 extend downward to support at least a portion of user 24 calf or lower leg portion 30 as best seen in FIG. 1. In this example, the user 24 would still have a full range of motion in the foot 34 or ankle which may be advantageous for healing or use of the wheelchair 14. For example, if it were advantageous for a user to have his or her leg supported so that the foot could not pass under the wheelchair subjecting the user to injury, then lower portion 56 could extend down to about mid-calf which still slightly elevates the foot 34 above the floor in a rest position, but the user could manipulate the ankle so the foot could touch the floor for example to propel the wheelchair forward or rearward. In other examples, if it were necessary to ensure the user's foot could not contact the floor, lower portion and second surface 90 could extend all of the way to the user's ankle or even beyond the heel of foot 34. For amputees where there is little or no lower leg portion 30, pad lower portion 56 could be much shorter or eliminated altogether.

An advantage of leg support 10 is that a user's lower leg portion 30 and foot 34 is supported such that the user's foot 34 is prevented from passing underneath the wheelchair or in the path of the front wheels, preventing injury to the user's foot, ankle or knee. Where only one leg support 10 is used, and a user utilizes the other leg and foot to propel the wheelchair, leg support 10 provides a soft or friendly surface in case the unsupported leg or foot comes in contact with leg support 10.

In one example of leg support 10, a clamp 140 is used to securely attach pad 48 to wheelchair seat 18 as best seen in FIGS. 1, 2 and 5. Clamp 140 preferably includes a first jaw 146, an opposing and spring-biased second jaw 150 each having serrated teeth 154 to promoting grip or retention of clamp 140 on seat 18. First 146 and second 150 jaws are preferably separated and operated by a hinge 160 and lockingly closed shut or clamped by a locking arm 170 rotatable about a pivot 176 as best seen in FIGS. 2 and 5. In a preferred operation, on release of locking arm 170, first 146 and second 150 jaws automatically open to receive a portion of seat 18. On rotation of locking arm 170 in the opposite direction, the jaws are forced to clamp down on seat 18, or other attaching surface. Once locking arm 170 rotates past a certain predetermined point, the locking arm "over-centers" and snaps toward a closed position locking the jaws closed on the seat.

Although one clamp 140 is shown, additional clamps 140 could be used. It is further understood that other types of fastening devices other than the clamp described as known by those skilled in the art. For example, a simple two-jaw, spring loaded clamp or clip could be used as well as a clamp with a rotating screw which applies pressure on an opposing jaw (not shown). It is further contemplated that an elongate wall parallel to the substantially horizontal upper portion could be positioned below the lower portion for receipt of the seat 18 between the walls to sandwich seat 18 on both sides without the use of active clamps or clips. Other devices known by those skilled in the art to securely attach leg support 10 to seat 18, or other seat, may be used. It is further contemplated that depending how far pad upper portion 50 is positioned toward the back of seat 18, positive attachment of pad 48 to seat 18 may not be needed. In other uses, it is contemplated that leg support 10 could be semi-permanently attached to a wheelchair 14 or other seat where a user is expected to use leg support 10 for a considerable period of time. In such cases, mechanical fasteners, adhesives or other attachment mechanisms described above and known by those skilled in the art may be used.

In one example of leg support 10, a storage hanger or hook 180 is used. As best seen in FIGS. 2 and 5, storage hanger 180 is attached to the underside of lower portion 56 forward of the wheelchair front wheels 22. Where a base 40 is used, hanger 180 is fixedly attached to base 40. In one example of hanger 180, a planar shank 186 is used and provides a flat surface to attach the hanger to lower portion 56 or base 40 as generally shown. Attached or integral with shank 186 is a hook portion 190. In operation, when the leg support 10 is not needed, it can be easily stored on the back of wheelchair seat behind user 24. In this position, the lower portion 56 generally hangs down and due to angle 64 between the upper portion 50 and lower portion 56, upper portion curves or curls under seat 18 out of the way of the user without impairing movement of wheelchair 14. Alternately, leg support can be hung from a utility hook or closet in a heath care facility preventing damage and keeping leg support 10 clean. It is understood that other storage hanger 180 devices can be used as known by those skilled in the art.

In the example shown in FIG. 5, connectors 200 may be used to connect one or more leg supports 10 together in side-by-side orientation. For example, two leg supports 10 can be positioned and attached together to provide support for both of a user 24 legs if both legs need to be supported. Connectors 200 can take many forms, for example mechanical fasteners, adhesive, hook and loop fabric connectors and other fastening means known by those skilled in the art. It is understood that connectors 200 may be positioned in other places other than the underside of lower portion 56 as shown.

Although leg support 10 is shown in an exemplary use with a wheelchair 14, it is understood that leg support 10 can be used with other seats or chairs where a user needs to support one or both legs for comfort or safety purposes, for example in a moving chair or walker devices which provide a seat, but which are movable.

In an example of a method of use or operation where a leg support 10 is used for one leg, the leg support 10 is positioned such that upper portion 50 is positioned on the top surface of the seat 18 as generally shown in FIG. 1. The leg support 10 is secured to the seat 18 through use of the clamp 140 to grip or engage the seat to securely attach pad 48 to the seat 18. In this position, the example pad 18 upper portion inclines toward the apex 96 and the lower portion extends downwardly toward the floor. It is understood that other methods and means for attaching leg support 10 to seat 18, or other surface, may be used as described above.

Once leg support 10 is secured to seat 18, a user 24 would be positioned to sit down on seat 18. The leg to be supported by leg support 10 may be lifted by the user, or manually lifted by a care giver, so that the upper leg portion 28 is allowed to rest on first surface 80. The user's knee would pass over apex 96 and the lower leg portion 30 allowed to rest on second surface 90. In the example pad 48 shown, the lower leg portion 30 would be positioned in relief 110 against support surface 120 so as to cradle the lower leg portion 30. This position provides additional comfort and resistance to the leg slipping off pad 48 or otherwise being dislodged thereby preventing unwanted or unauthorized movement of the leg. The leg that is not supported by leg support 10 is free to move or propel the user 24. It is understood that the user 24 could first be seated on seat 18 and then leg support 10 installed depending on the circumstances or application.

On removal of leg support 10 from seat 18, the clamp 140 can be disengaged from seat 18 and the leg support 10 gently slid out from under the supported leg. Alternatively, the user's leg can be gently removed from being supported by pad 48 or the user can be removed from the chair 14 before the leg support 10 is removed. It is understood that if a clamp 140 or other means for engaging leg support 10 to seat 18 is not used or required, the disengagement step can be eliminated.

When the leg support 10 is not needed, it can be hung and stored through use of storage hanger 180. In one example, hook 190 can be used to hang the leg support 10 from the back side of the chair 18 seatback.

In alternate examples of methods of use or operation, where two leg supports 10 are needed to support both a user's legs, two leg supports 10 can be connected together in side-by-side fashion through connectors 200. In this method, installation of leg support 10 would be made after the user 24 is positioned in seat 18.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A leg support for use by a user sitting on a seat supported by a floor, the seat having a forward seat edge, the user having a hip, an upper leg, a lower leg, a knee, a lower leg calf, a foot and a buttocks, the leg support comprising:

a pad having an upper portion;

a first end adapted to be positioned over a portion of the seat;

a seat contact surface adapted for overlapping and abutting contact with the seat;

an elongate first surface positioned above the upper portion extending angularly upward from the first end toward an apex, the first surface adapted to elevate a user's knee and support substantially the entire upper leg of the user;

a lower portion extending angularly downward and away from the upper portion; and an elongate second surface positioned above the pad lower portion extending angularly downward from the first surface and apex to a second end positioned vertically lower than the first end, the second end adapted to extend outwardly from and below the forward seat edge without vertical support other than from the seat and pad upper portion, the second end adapted to terminate adjacent to or below the user's calf to angularly elevate and suspend the user's foot between the seat and the floor.

2. The leg support of claim 1 wherein the first surface first end is adapted to be substantially flush with the seat and positioned below a portion of the user's buttocks, the first surface extending upward at a substantially constant incline between the first end and the apex.

3. The leg support of claim 2 wherein the first surface is substantially planar between the first end and the apex.

4. The leg support of claim 2 wherein the first surface defines a first length between the first end and the apex, the second surface defining a second length between the apex and the second end, the second second length being greater than the first length.

5. The leg support of claim 2 wherein the first surface extends angularly upward from the seat contact at the first end at an angle of about 30-60 degrees.

6. The leg support of claim 1 wherein the second surface extends downwardly at a substantially constant decline between the apex and the second end.

7. The leg support of claim 6 wherein the second surface extends substantially planar between the apex and the second end.

8. The leg support of claim 6 wherein the lower portion defines a concave relief portion in the second surface.

9. The leg support of claim 1 further comprises means connected to the lower portion opposite the second surface for hanging storage of the leg support when the leg support is not in use.

10. The leg support of claim 9 wherein the means for hanging storage comprises a hook.

11. The leg support of claim 1 further comprising a means for connecting the pad to the seat to prevent unwanted movement of the pad relative to the seat, the connecting means positioned opposite the upper portion first surface adjacent the seat.

12. The leg support of claim 1 wherein the second surface extends angularly downward from the first surface at an angle between about 70 and 120 degrees.

13. The leg support of claim 12 wherein the angle is approximately 90 degrees.

14. A chair leg support device for use in angularly elevating and supporting a user's lower leg and foot above a floor while the user is seated on a chair, the user having a buttocks, upper leg, a knee, a lower leg calf and a foot, the device comprising:

a chair supported by a floor, the chair having a substantially horizontal seat and a front seat edge;

a leg support pad comprising:

an upper portion defining an elongate first surface extending angularly upward from a first end toward an apex, the elongate first surface adapted for supporting substantially all of the user's upper leg between the buttocks and the knee;

a lower portion extending angularly downward from the upper portion and away from the front seat edge, the lower portion defining a second surface terminating at a second end positioned below the first end and the seat front edge, the elongate second surface adapted for supporting substantially all of the user's lower leg between the knee and the lower leg calf, the second end adapted to be positioned between the user's calf and foot to angularly elevate and suspend the user's otherwise vertically unsupported foot forward of the front seat edge and above the floor.

15. The device of claim 14 wherein the chair comprises a movable wheelchair having a pair of front wheels and a pair of rear wheels rotatably connected to the chair, the pad lower portion second surface and second end adapted to angularly position and suspend the user's foot forward of and vertically above the front wheels.

16. The device of claim 15 wherein the pad second surface extends angularly downward from the first surface at an angle between about 70 and 120 degrees.

17. The device of claim 16 wherein the pad lower portion second surface defines a concave channel extending into the pad lower portion adapted to partially surround and prevent the user's lower leg from displacement from the pad while the wheelchair is in motion.

18. A leg support for use by a user sitting on a seat, the user having an upper leg, a lower leg, a lower leg calf, a foot and a buttocks, the leg support comprising:

a pad having an upper portion;

a first end adapted to be positioned over a portion of the seat;

a seat contact surface adapted for overlapping and abutting contact with the seat;

a first surface positioned above the upper portion extending angularly upward from the first end toward an apex, the first surface adapted to support the user's upper leg;

a lower portion extending angularly downward and away from the upper portion and is adapted to be free from contact from the seat;

a second surface positioned above the pad lower portion extending angularly downward from the first surface and apex to a second end adapted to be positioned adjacent to or below the user's calf; and a hangar connected to the pad lower portion positioned opposite the second surface for hanging storage of the leg support when the leg support is not in use.

* * * * *